US009966205B1

(12) United States Patent
Dixon et al.

(10) Patent No.: US 9,966,205 B1
(45) Date of Patent: May 8, 2018

(54) CIRCUIT BREAKER LOCKOUT SYSTEM WITH TIE-RECEIVING CHANNELS

(71) Applicant: The Boeing Company, Chicago, IL (US)

(72) Inventors: Robert Dean Dixon, Everett, WA (US); Thomas R. Swineford, Marysville, WA (US)

(73) Assignee: The Boeing Company, Chicago, IL (US)

( * ) Notice: Subject to any disclaimer, the term of this patent is extended or adjusted under 35 U.S.C. 154(b) by 0 days. days.

(21) Appl. No.: 15/452,608

(22) Filed: Mar. 7, 2017

(51) Int. Cl.
*H01H 9/28* (2006.01)
*H01H 9/20* (2006.01)
*H01H 71/10* (2006.01)

(52) U.S. Cl.
CPC ..... *H01H 9/20* (2013.01); *H01H 9/287* (2013.01); *H01H 71/1054* (2013.01)

(58) Field of Classification Search
CPC ..... H01H 71/1054–9/286; H01H 9/287; E05B 13/001–55/00
USPC ..... 200/43.13; 70/174, 207
See application file for complete search history.

(56) References Cited

U.S. PATENT DOCUMENTS 3,739,608 A * 6/1973 Young ..... E05B 13/001 70/209
4,069,692 A * 1/1978 Hemphill ..... B60R 25/007 244/224
5,207,315 A * 5/1993 Benda ..... H01H 9/283 200/43.11
9,064,646 B2 * 6/2015 Wavering ..... H01H 9/286
9,570,251 B2 * 2/2017 Weaver ..... H01H 9/286

* cited by examiner

*Primary Examiner* — Vanessa Girardi
(74) *Attorney, Agent, or Firm* — Francisco A. Rubio-Campos; Apogee Law Group P.C.

(57) ABSTRACT

A lockout system for preventing a push-pull circuit breaker from being depressed while personnel work on de-energized electrical equipment. The lockout system includes an attachment member having a generally C-shaped collar defining a cylindrical recess integrated with a retainer member. The C-shaped collar is configured to resiliently expand in order to be positioned over and receive a cylindrical portion of an extended circuit breaker knob such that engagement of the circuit breaker is prevented. The retainer member includes a first channel member and a second channel member, each with a channel connected by a crossover channel that forms a continuous channel configured to receive a wire cable. Once inserted, the wire cable is firmly held in place by a locking chamber attached at each end of the wire cable, and thereafter, the lockout device can only be removed by a cutting the wire cable with a wire cutting tool.

20 Claims, 7 Drawing Sheets

CIRCUIT BREAKER LOCKOUT SYSTEM WITH TIE-RECEIVING CHANNELS

BACKGROUND

1. Technical Field

The present disclosure generally relates to affixing appropriate lockout devices to energy isolating devices and, more particularly, to a system and method for preventing the inadvertent engagement of a manually operated push-pull electrical circuit breaker on a circuit breaker panel.

2. Background of the Invention

Under regulations of the U.S. Occupational Safety and Health Administration ("OSHA"), e.g., Control of Hazardous Energy (Lock-Out/Tag-Out) ("LOTO") standards, Title 29, Code of Federal Regulations (CFR) Parts 1910.147 and 1910.333, employers are required to establish programs and establish procedures for affixing appropriate lockout and tagout devices to energy isolating devices to prevent unexpected energization or start up or release of stored energy whenever work is performed near or on equipment or circuits that are or may be energized, in order to prevent electric shock or other injuries to employees.

Energy isolating devices, in general, are mechanical devices that physically prevent the transmission or release of energy and include manually operated push-pull electric circuit breakers. Under these standards, a person servicing, for example, electrically-powered machines or equipment is required to disengage a circuit breaker coupled to the machines or equipment and apply a locking or "lockout" device to the circuit breaker to prevent the circuit breaker from inadvertently engaging while the equipment is being serviced. Specifically, the lockout device should be substantial enough to prevent removal of the lockout device from the circuit breaker without "the use of excessive force or unusual techniques, such as with the use of bolt cutters or other metal cutting tools." This means that the lockout device must include a positive means, such as a padlock shackle or a high security cable, to hold the energy isolating device in a safe position, i.e., a position that keeps the circuit breaker open.

In addition to being de-energized and locked-out, the OHSA regulations also require that such equipment or circuits be tagged with a tagout device containing a statement prohibiting unauthorized operation of the disconnecting means and removal of the tag, as well as warning that the equipment and circuits are not to be operated until the tagout device is removed. A tag with such statements may also contain serial number(s) identifying the circuit breaker unit and the equipment or circuits coupled to the circuit breaker unit, and names of the person(s) performing the lockout.

Like the lockout device, the means of attachment for the tags are also subject to OHSA standards to prevent inadvertent or accidental removal. For example, the tagout device attachment means should be of a non-reusable type, attachable by hand, self-locking, and non-releasable with a minimum unlocking strength of no less than 50 pounds and having the general design and basic characteristics of at least the equivalent of a one-piece, all environment-tolerant nylon cable tie. Also, tagout devices are to be constructed and printed so as to be capable of withstanding their environment and exposure such that the tag will not deteriorate or its message become illegible.

In applying the LOTO standards to, for example, circuit breaker panels in aircraft structures, manually operated push-pull circuit breakers commonly used in these types of applications must be disengaged from the circuit breaker panel before a technician may service equipment or circuits coupled to the circuit breaker. Once the circuit breaker is disengaged, a lock-out device must be secured to the circuit breaker knob to prevent the circuit breaker from being depressed. One example of a commonly used lock-out device is the multipart Skykit® system (which includes the Skylox®, Skyvault®, Skytag®, and Skyclip® parts), sold by Kascar, LLC, One Kascar Plaza, Greenville, S.C. 29605. Such lock-out devices, while effective, have some drawbacks.

First, existing lockout devices are bulky and often protrude out from the circuit breaker panel. In some instances, the lock-out devices may protrude from the circuit panel more than an inch or so. This protrusion reduces the useable workspace of a technician because the passageways in electrical bays ("E-bay") of aircraft structures may be very tight and, as such, technicians may frequently snag or bump into the lockout device while passing through the E-bay. Because circuit breaker knobs are not intended to be loaded, only to be pushed in or pulled out, the circuit breaker knobs upon which the lockout devices are applied may be sheared or snapped-off when the lockout devices are inadvertently engaged by a technician passing through the E-bay.

A second characteristic of existing lockout devices is that they generally comprise several parts. For example, the commonly used Skykit® system comprises six separate parts: the Skylox® (which comprises two half-shells and an O-ring), the Skyvault®, the Skytag®, and the Skyclip®. In the aviation industry, in particular, objects lying around an aircraft that are not part of the operation are referred to as foreign object debris (FOD), which refers to any substance, debris or article alien to a vehicle or system which could potentially cause damage. FOD often migrate around aircraft structures and the use of existing multi-part lock-out devices increases FOD risk.

Accordingly, there is a need for a low profile, compact lock-out system comprising a minimal number of parts, but that also includes retaining means and a lock that holds the lock-out system in its safe position, and that is easily attachable and conforms to applicable OHSA standards.

SUMMARY

A lockout system is provided for preventing a manually operated push-pull circuit breaker from being inadvertently depressed once it has been disengaged while personnel are working on or near de-energized equipment or circuits. In one example, the lockout system may include an attachment member having a generally C-shaped collar defining a cylindrical recess therein. The attachment member is configured to be resiliently expanded such that the C-shaped collar is positioned over and receives a cylindrical portion of the circuit breaker knob when the circuit breaker has been manually extended (e.g., by pulling) or automatically extended (i.e., by popping out).

Once installed, the C-shaped collar is disposed between the circuit breaker knob and a circuit breaker housing so as to restrict actuation of the circuit breaker knob, i.e., preventing depressing the circuit breaker knob inwards into the circuit breaker housing. Thus the C-shaped collar should be constructed with a sufficient height to prevent the circuit breaker knob from being depressed, as well as having an interference fit between the circuit breaker knob and the circuit breaker housing.

The lockout system further includes an integrated retaining member comprising first and second channel members depending from a bottom portion of the C-shaped collar of the attachment member. Each of the first and the second channel members include a horizontal portion and a vertical portion, within which a single, continuous cable channel is formed, running from an end of the vertical portion of the first channel member, then through the horizontal portion of the first channel member to a crossover channel connecting the first channel member to the second channel member, and then to the horizontal portion of the second channel member and ending at an end of the vertical portion of the second channel member.

The cable channel is configured to receive and snugly retain in place a wire cable or other type of high security metal tie, which is threaded through the first and the second channel members and the crossover channel such that portions of the wire cable extend from the ends of the vertical portions of the first and the second channel members, wherein the extensions of the wire cable may be inserted into a locking mechanism such that the locking mechanism will hold the lockout system in place on the disengaged circuit breaker. Once attached to the circuit breaker knob, the lockout system including the wire cable and the locking mechanism may be removed only by cutting the wire cable with a bolt cutter or other metal cutting tool.

A method for preventing actuation of a push-pull circuit breaker knob is further provided. The method includes disengaging the circuit break knob from its corresponding circuit breaker panel and applying a lockout device having an attachment member about an actuating cylindrical portion of the circuit breaker knob (or applying the attachment member about an actuating cylindrical portion of a popped-out circuit breaker knob). The attachment member includes a generally C-shaped collar defining a cylindrical recess therein and is configured to be resiliently expanded to be positioned over and receive the cylindrical portion of the circuit breaker knob and then automatically contract to attach itself firmly to the cylindrical portion of the circuit breaker knob.

Once the attachment member is in place, a wire cable or other types of ties may be threaded through the cable channel of the retainer member, such that ends of the wire cable extend beyond each end of the vertical portions of the first and the second channel member. In other examples of methods for preventing actuation of a push-pull circuit breaker knob, the wire cable may be pre-threaded into the retainer member of the lockout device prior to its being attached to the extended circuit breaker knob.

The method further includes coupling a locking mechanism to the extended ends of the threaded wire cable, which locking mechanism is pushed against the bottom of the lockout device to hold it in a safe position on the circuit breaker knob. An example of a locking mechanism may be a rectangular locking chamber having a pair of passageways or channels, wherein an end of the wire cable may be inserted into each passageway and pull tightened, each of the passageways having internal ratchets that allow the wire cable to be inserted in one direction only to hold the locking chamber firmly in place, thus keeping the locking device from being removed from the circuit breaker without a metal cutting tool.

Once the work on the de-energized equipment or circuit is completed, the lockout device may be removed by cutting the wire cable at any point above the locking chamber. Once the wire cable has been cut, the locking device can be removed from the circuit breaker and the wire cable can be removed from the locking chamber, allowing its re-use.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE FIGURES

The present disclosure may be better understood by referring to the following figures. The components in the figures are not necessarily to scale, emphasis instead being placed upon illustrating the principles of this disclosure. In the figures, like reference numerals designate corresponding parts throughout the different views.

DETAILED DESCRIPTION

Figure 1A:
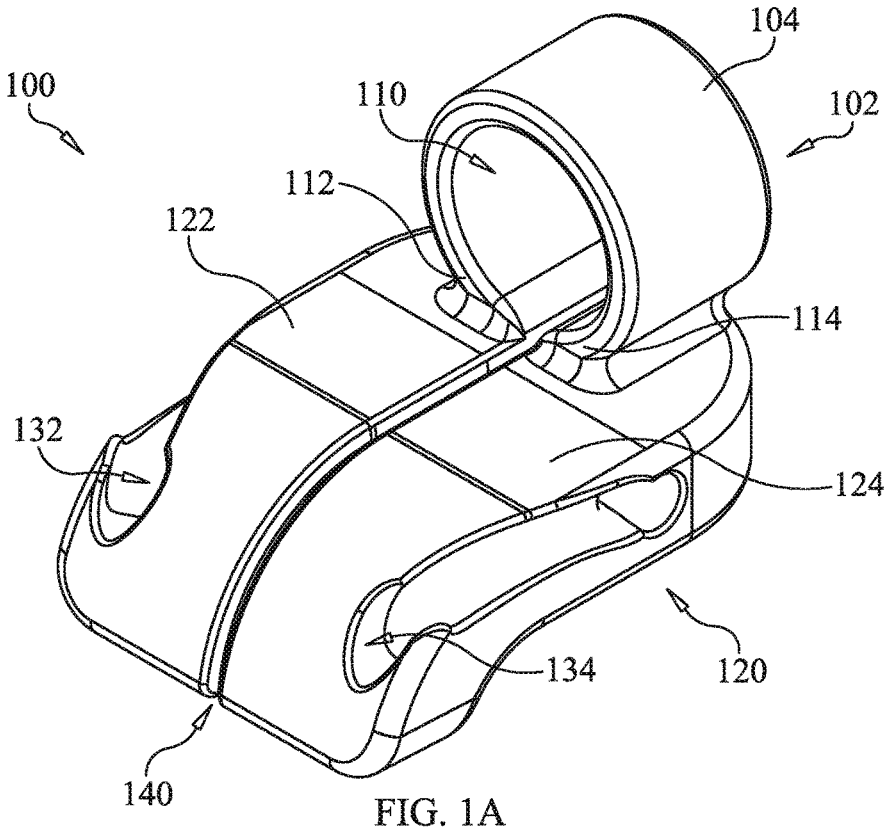
FIG. 1A shows a perspective view of an example of a lockout device comprising an attachment member together with an integrated retainer member of a lockout system for preventing an extended push-pull circuit breaker from being depressed, in accordance the present disclosure.

A lockout system of preventing a manually operated push-pull circuit breaker from being inadvertently depressed once it has been disengaged while personnel are working on or near de-energized equipment or circuits is provided. FIG. 1A shows a perspective view of an example of a lockout device 100 comprising an attachment member together with an integrated (i.e., one piece) retainer member of a lockout system for preventing an extended push-pull circuit breaker from being depressed, in accordance the present disclosure.

In FIG. 1A, attachment member 102 is shown having a generally C-shaped collar 104 defining a cylindrical recess 110 therein and having a first free end 112 and a second free end 114.

Depending from the attachment member 102 is retainer member 120, which is attached to the attachment member 102 at its first free end 112 and its second free end 114. The retainer member 120 includes a first channel member 122 and a second channel member 124 wherein each channel member 122, 124 includes a portion of a continuous cable channel (not shown) of the lockout system. A first channel opening 132 to a portion of the cable channel (not shown) of the retainer member 120 is shown, as well as a second channel opening 134 to a portion of the cable channel (not shown) of the retainer member 122 is also shown. In general, the cable channel of the lockout system is formed within the lockout system and is a single continuous channel connecting the first channel opening 132 and the second channel opening 134, and is shown in the FIGs. and described in more detail below.

The attachment member 102 together with the retainer member 120 of a lockout system is a single integrated piece that may be made from acrylonitrile butadiene styrene (ABS), polymethyl methacrylate (PMMA), polystyrene, combinations of the foregoing, and various other thermoplastics and resins having similar pliant and electrically non-conductive properties. Moreover, the mode of manufacture of the lockout system may include 3D printing when using ABS. More specifically, the attachment member 102 can be made of any material that enables the C-shaped collar 104 to flex apart at its first free end 112 and its second free end 114, which are separated by the gap 140 that is formed along the entire length of the attachment member 102 together with retainer member 120. As an example, the width of the gap 140 may be approximately 0.020". As force is applied to the either the first channel member 122 or the second channel member 124, the C-shaped collar 104 is resiliently pressed apart and positioned over and receives the cylindrical portion of an extended circuit breaker knob (not shown) and then contracts automatically when in position to remain snuggly fitted to the cylindrical portion of the extended circuit breaker knob.

Figure 1B:
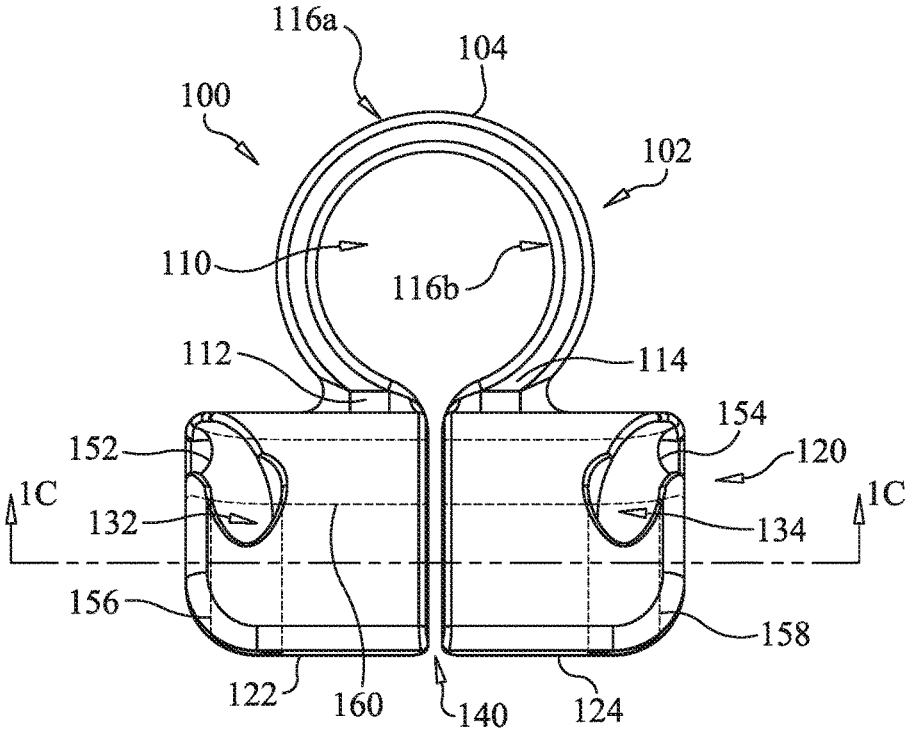
FIG. 1B is a front view of the attachment member with integrated retainer member shown in FIG. 1A.

Turning to FIG. 1B, a front view of the attachment member 102 with integrated retainer member 120 of FIG. 1A is shown, with the attachment member 102 having a generally C-shaped collar 104 defining a cylindrical recess 110 therein. The cylindrical recess 110, as an example, may have an outside radius 116*a* of 0.22" and an inside radius 116*b* of 0.17". The retainer member 120 is shown below the attachment member 102, with the first channel opening 132 of the first channel member 122 and the first channel opening 134 of the second channel member 124 also shown.

Portions of the cable channel not visible in this view are shown with dashed lines. For example, the crossover channel 160 is shown (with dashed lines) passing horizontally from the first channel member 122 to the second channel member 124 of the retainer member 120. Vertical channel 156 of the first channel member 122 is shown (with dashed lines), as is vertical channel 158 of the second channel member 124. Also shown is a portion of the first horizontal channel 152 of the first channel member 122 and a portion of the second horizontal channel 154 of the second channel member 124, and the gap 140 separating the first channel member 122 and the second channel member 124 of the retainer member 120, as well as the first free end 112 and the second free end 114 of the attachment member 102.

Figure 1C:
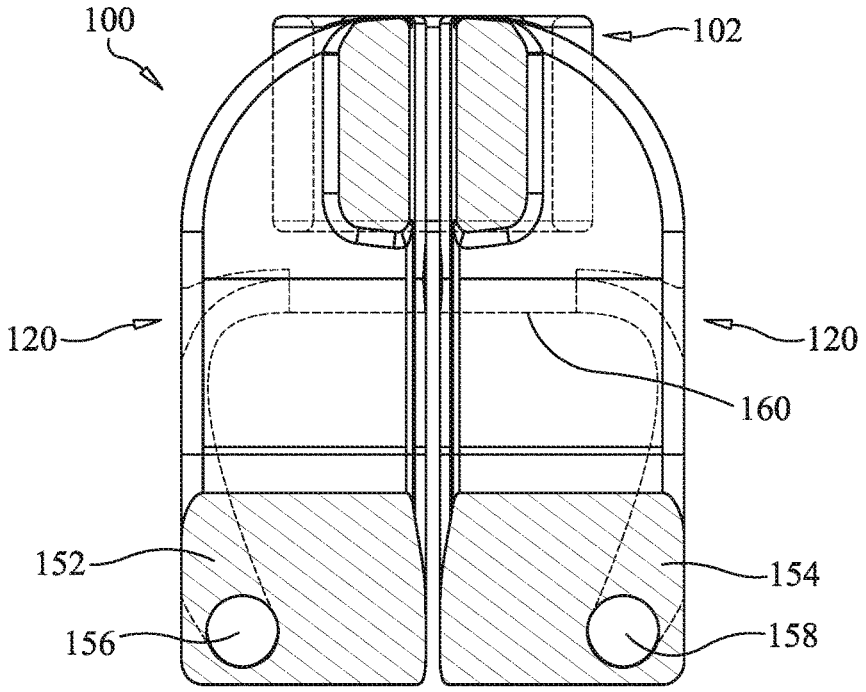
FIG. 1C is a section view of the attachment member with integrated retainer member shown in FIG. 1A along the line 1C-1C shown in FIG. 1B.

Turning to FIG. 1C, a section view of attachment member 102 and retainer member 120 shown in FIG. 1A along the line 1C-1C as shown in FIG. 1B is shown. Cross-sections of the vertical channels 156 and 158 of the retainer member 120 are shown, together with the first horizontal channel 152 and the second horizontal channel 154 and the crossover channel 160 are all shown in dashed lines because these elements are not visible in this view. Again, the first horizontal channel 152, the second horizontal channel 154, the vertical channels 156 and 158, and the crossover channel 160 together form a single, continuous cable channel in the retainer member 120.

Figure 1D:
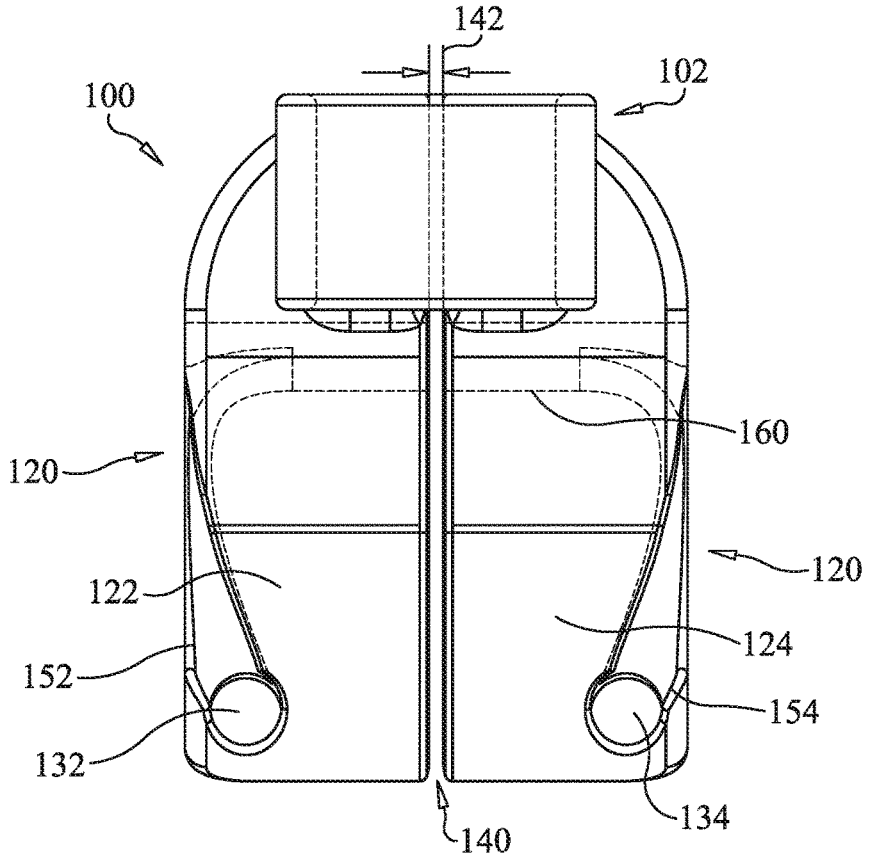
FIG. 1D is a bottom view of the attachment member with integrated retainer member shown in FIG. 1A.

FIG. 1D is a top view of the attachment member 102 with integrated retainer member 120 shown in FIG. 1A. The attachment member 102 includes a generally C-shaped collar 104 that may be resiliently pressed apart and positioned over and receive the cylindrical portion of an extended circuit breaker knob (not shown) and then contracts to remain snuggly fitted to the cylindrical portion of the extended circuit breaker knob.

Retainer member 120 is shown with first horizontal channel 152 of the first channel member 122 and the second horizontal channel 154 of the second channel member 124. Also shown are openings 132, 134 to vertical channels 156 and 158, respectively, in the first channel member 122 and the second channel member 124, respectively. One end of the first horizontal channel 152 is connected an upper end of a vertical channel 156, and one end of the second horizontal channel 154 is connected an upper end of a vertical channel 158. The ends of the first horizontal channel 152 and the second horizontal channel 154 are connected to a left end and a right end, respectively, of crossover channel 160. Thus the horizontal channels 152 and 154 are connected by crossover channel 160 (shown in dashed lines because this crossover channel 160 is not visible in this view). The first horizontal channel 152, the second horizontal channel 154, the vertical channels 156 and 158, and the crossover channel 160 together form a single, continuous channel in the retainer member 120 configured to secure and hold in place a wire cable (not shown), where all connections of the cable channel may be rounded.

The lengths of the horizontal channels 152 and 154 may vary, and may be constrained by workspace considerations; for example, the aforementioned tight passageways in E-bays of aircraft structures. Likewise, the lengths of the vertical channels 156 and 156 are also constrained in that while an extended length of these vertical channels may provide greater tension within the lockout device, the placement of the lockout device on a circuit breaker knob on a circuit breaker panel with many other circuit breaker knobs may limit the length of the vertical channels 156 and 158 as well as the length of the wire cable that extends from a locking mechanism on the lockout device.

Figure 1E:
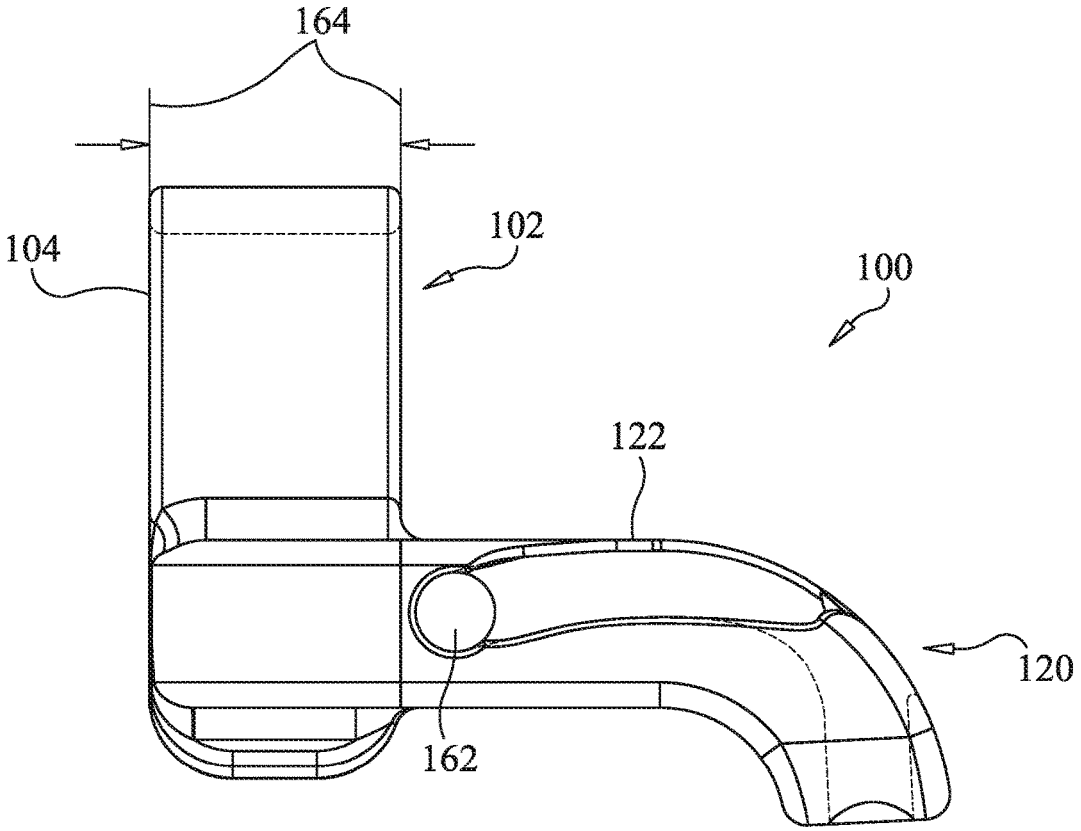
FIG. 1E is a side view of the attachment member with integrated retainer member shown in FIG. 1A.

FIG. 1E is a side view of the attachment member 102 with the retainer member 120 shown in FIG. 1A. The width 164 of the attachment member 102 may be, as an example, approximately 0.30", which dimension may vary dependent on the dimensions of a particular circuit breaker and circuit breaker panel. The first channel member 122 of the retainer member 120 is shown with a circle 162 with dashed lines, representing a cross section of crossover channel 160, which is not visible in this view. As an example, the diameter of the crossover channel 160 may be approximately 0.10", which would call for use of a flexible steel wire with a diameter of 1.8 mm (or 3/32"). This figure assists in disclosing a position of a crossover channel relative to the attachment member 102 and the retainer member 120.

Figure 2:
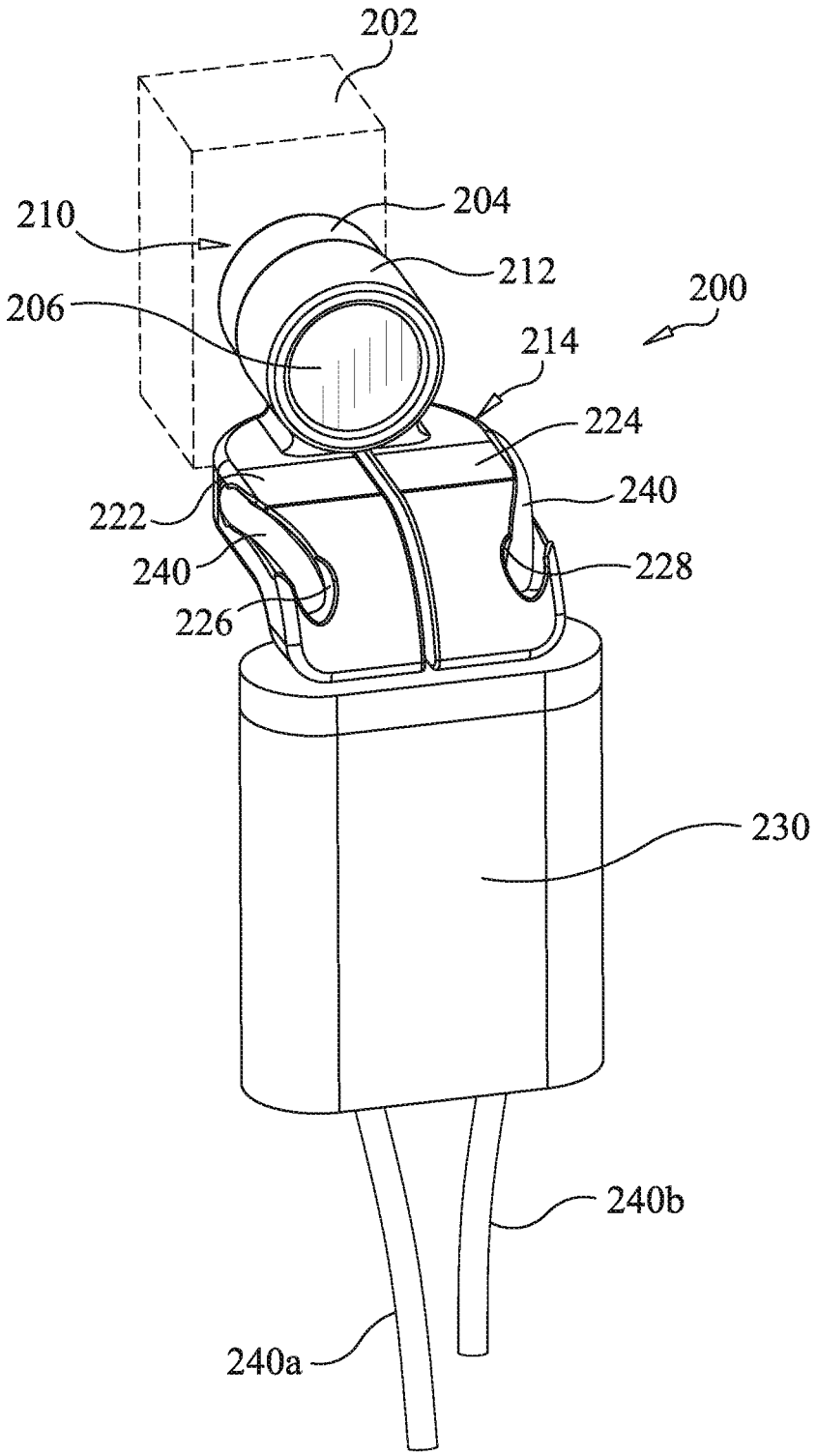
FIG. 2 is a perspective view of an example of a lockout system for preventing an extended push-pull circuit breaker from being depressed, in accordance with the present disclosure, assembled and shown attached to a single push-pull circuit breaker on a portion of a circuit panel.

FIG. 2 is a perspective view of an example of an assembled lockout system 200 for preventing an extended push-pull circuit breaker from being depressed, in accordance the present disclosure, shown attached to a single extended push-pull circuit breaker. In FIG. 2, a portion of a circuit breaker panel 202 is shown with an extended circuit breaker 204. Attached to a cylindrical portion of the extended circuit breaker 204 and behind a circuit breaker knob 206 is a lockout system 210 in accordance with the present disclosure, having an attachment member 210 and an integrated retainer member 214. The attachment member 210 includes a generally C-shaped collar 212, which is shown firmly in place on the extended circuit breaker 204, with the C-shaped collar 212 trapped between the circuit breaker knob 206 and an annular housing or spacer (not shown) on the circuit breaker panel 202, thus preventing inadvertent engagement of the extended circuit breaker 204.

The retainer member 214 includes a first channel member 222 and a second channel member 224, each of which includes a portion of a cable channel formed in the retainer member 214 that is configured to secure and hold in place a wire cable 240, wherein the wire cable 240 has a length sufficient to pass through the cable channels 226 and 228 in the first channel member 222 and the second channel member 224, respectively, which may be connected by a crossover channel (not shown), and that includes wire cable extensions 240*a* and 240*b*.

In FIG. 2, the lockout system 200 is shown fully assembled, with wire cable extensions 240*a* and 240*b* shown pulled through passageways or channels in locking chamber 230, such that the locking chamber 230 places tension on the wire cable 240 that forces the first channel member 222 and the second channel member 224 together, thus also maintaining the C-shaped collar 212 in place on the cylindrical portion of the extended circuit breaker 204. Additional tension is placed on the C-shaped collar 212 by way of the wire cable 240 passing through a crossover channel (not shown) connecting the cable channels 226 and 228. The wire cable 240 may be a flexible steel wire of varying diameters, such as 5⁄64" (1.8 mm), 3⁄32" (2.5 mm), 5⁄32" (3.6 mm), and 3⁄16" (5.0 mm).

Figure 3A:
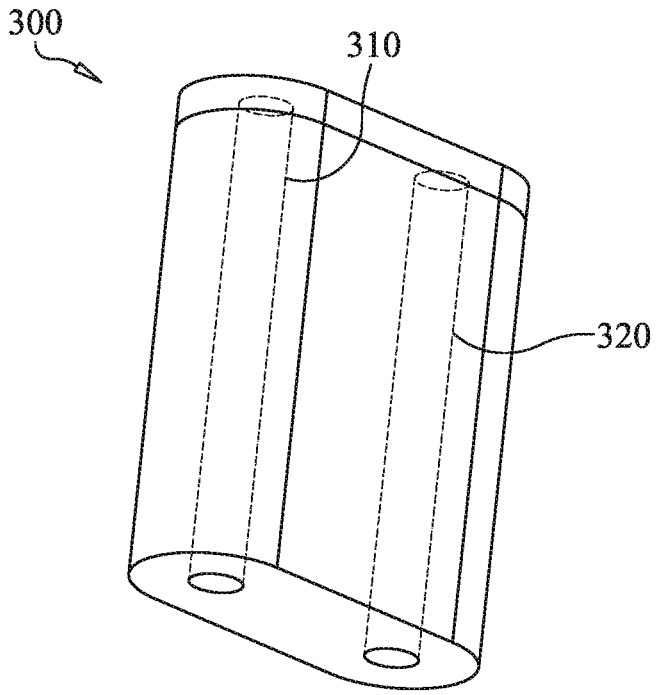
FIG. 3A is an enlarged perspective view of a locking chamber that may be installed on a lockout system for preventing an extended push-pull circuit breaker from being depressed, in accordance with the present disclosure.
Figure 3B:
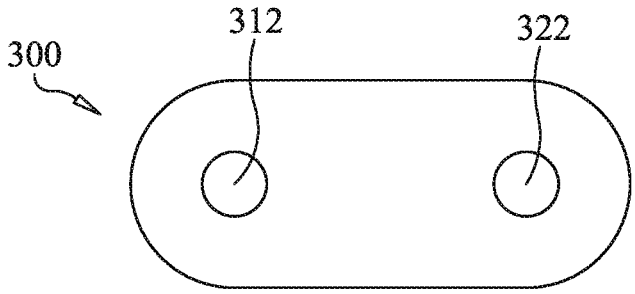
FIG. 3B is a top view of the locking chamber shown in FIG. 3A.
Figure 3C:
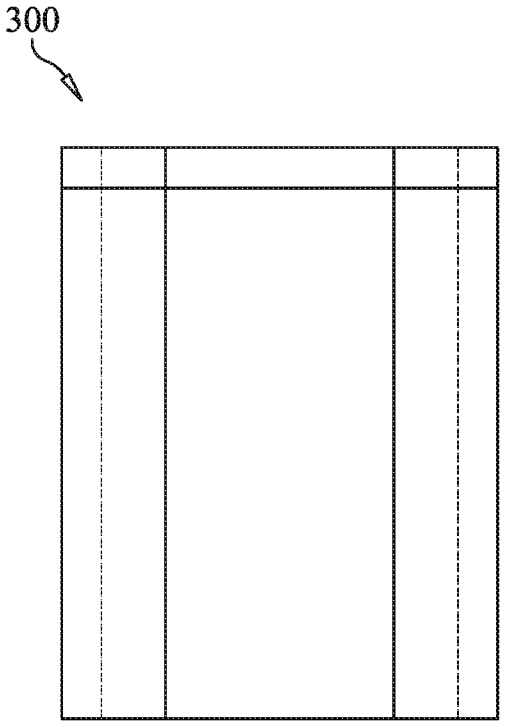
FIG. 3C is a plan view of the locking chamber shown in FIG. 3A.
Figure 3D:
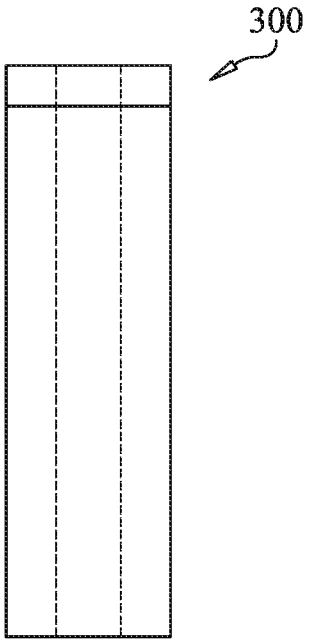
FIG. 3D is a side view of the locking chamber shown in FIG. 3A.
Figure 3E:
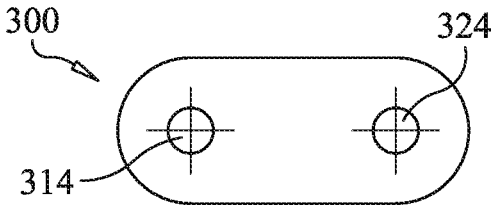
FIG. 3E is a bottom view of the locking chamber shown in FIG. 3A.

FIG. 3A is an enlarged perspective view of a locking chamber 300 that may be installed on a lockout system for preventing an extended push-pull circuit breaker from being depressed, in accordance with the present disclosure, and FIG. 3B is a top view of the locking chamber 300 shown in FIG. 3A. In general, locking chamber 300 may be any mechanism that will accept the two ends of a wire cable threaded through the lockout device and hold these ends firmly in place as the ends are pulled through two passageways in the locking chamber 300.

In the embodiment shown in FIG. 2 and FIGS. 3A-3E, locking chamber 300 may be a modified version of the locking mechanisms typically found in cable seals comprising a flexible steel cable and a metal body with a pull-to-tighten cable seal. These types of locking mechanisms are generally used for high security single-use applications, and the cable seals may be of a fixed length type (where the cable seal is locked by inserting a push pin into a locking mechanism) or an adjustable length type (where the cable seal is locked by threading a loose cable end into and through a channel of a locking mechanism).

In FIGS. 3A-3E, instead of one fixed channel and one open channel or one locking channel configured to receive a push pin, locking chamber 300 is a locking chamber having two open ended pull-to-tighten channels 310 and 320. In FIG. 3B, an inlet 312 to channel 310 and an inlet 322 to channel 320 is shown, and in FIG. 3E, an outlet 314 of channel 310 and an outlet 324 to channel 320 is shown. In general, a locking chamber 300 as shown in FIGS. 3A-3E may be manufactured from a conventional adjustable cable seal locking mechanism by drilling a hole in the outlet of the channel configured to hold the fixed end of the cable. With this modification, both passageways or channels of the locking chamber 300 are configured to receive cable ends that may be pushed through the locking chamber 300 (or reverse pulled to tighten the cable).

Figure 4:
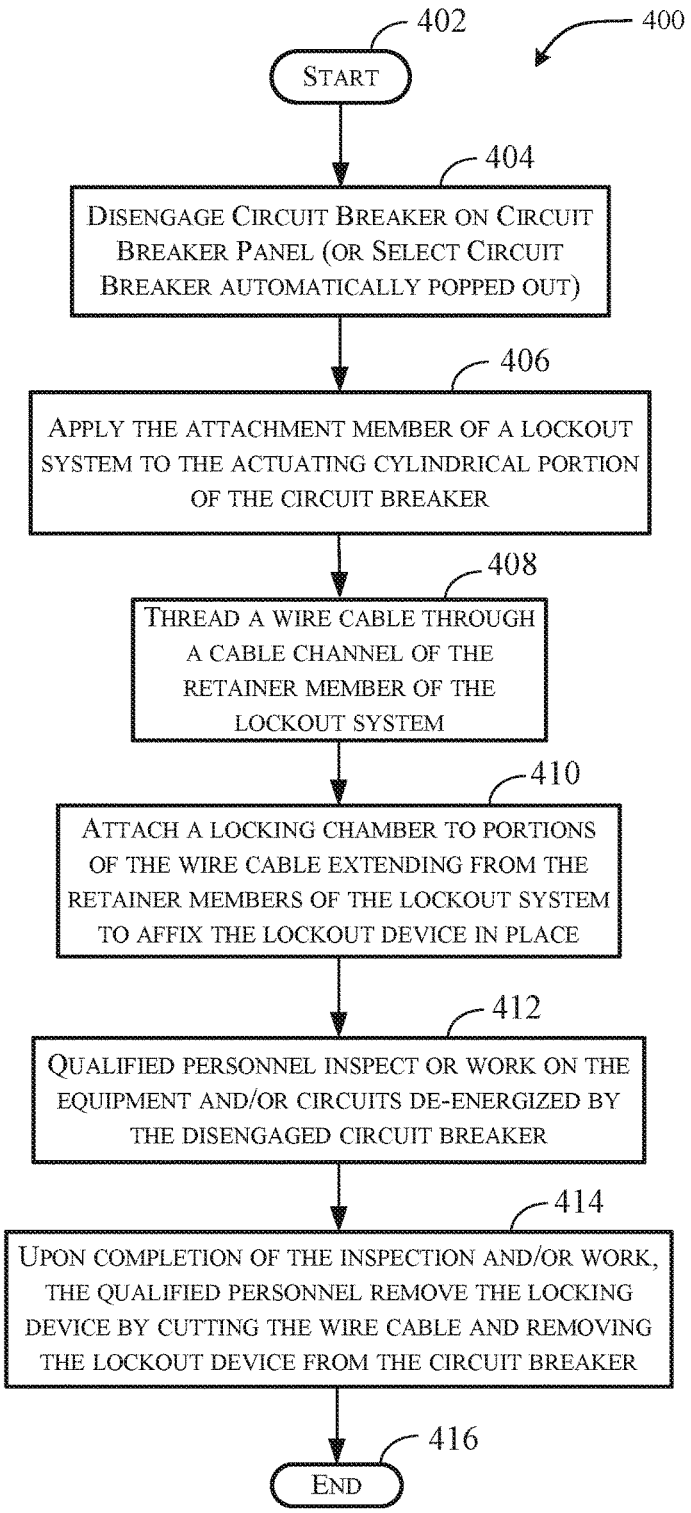
FIG. 4 illustrates a flow diagram of one example of a method of installing and removing a lockout system for preventing actuation of a push-pull circuit breaker knob according to the present disclosure.

With reference now to FIG. 4, an example of a method of preventing the actuation of a push-pull circuit breaker knob is illustrated in flow diagram 400. The method starts in step 402, and in step 404, a push-pull circuit breaker knob is extended from its corresponding circuit breaker panel on the equipment or circuits being inspected or serviced by a qualified person. (Alternatively, the qualified person may detect an automatically-extended circuit breaker on a circuit breaker panel and commence inspection or service of the affected equipment or circuits.) Next, a lockout system is applied about an actuating cylindrical portion of the circuit breaker knob (step 406). The lockout system includes an attachment member having a generally C-shaped collar defining a cylindrical recess therein, where the C-shaped collar is configured to resiliently expand to be positioned over and receive the cylindrical portion of the circuit breaker knob, and once in place, the C-shaped collar contracts to remain firmly in place.

In step 408, a wire cable may be threaded through a cable channel of the lockout device, starting at a vertical portion of a first channel member and passing through a crossover channel to the second channel member and then through the second channel member. Portions of the wire cable extend from ends of the first channel member and the second channel member of a length sufficient to engage passageways of a locking chamber that will hold the lockout device in place on the cylindrical portion of the circuit breaker knob. It is appreciated by those skilled in the art that the wire cable may be threaded through the cable channel of the lockout device either before or after placing the lockout device on the cylindrical portion of the circuit breaker knob.

Once the lockout device is in place on the cylindrical portion of the circuit breaker knob with portions of the wire cable extending from ends of the first and the second channel members, a locking chamber having two pull-tight passageways is attached to the lockout device by threading the ends of the wire cable into and through the passageways such that the locking chamber holds the lockout device firmly in place on the cylindrical portion of the circuit breaker knob (step 410). Additionally, with the wire cable passing through the crossover channel (160, FIG. 1B), there is an additional force applied to the first and the second channel members that helps keep the C-shaped collar firmly attached to the cylindrical portion of the circuit breaker knob and prohibits the C-shaped collar from being forcibly removed from the circuit breaker knob.

In step 412, qualified personnel inspect or work on or near the equipment and/or circuits de-energized by the extended circuit breaker held in place by the lockout system. When the inspection or work is completed, qualified personnel may remove the lockout device from the cylindrical portion of the circuit breaker knob. Pursuant to the applicable OHSA rules, this will require removal of the lockout system by cutting the wire cable with a metal cutting tool, e.g., a wire cutter, in step 414. By cutting the wire cable at a point above the lockout chamber, the lockout chamber can be removed from the lockout device, the wire cable can be removed from the lockout device, and then the C-shaped collar can be removed from the cylindrical portion of the circuit breaker knob. The process ends at step 416.

While the foregoing implementations of the present disclosure are described in use in commercial aircraft structures, the present disclosure may also apply to military aircraft, spacecraft, missile systems, commercial structures, and other applications where push-pull circuit breakers are used to power equipment, circuits, or machines. In general, terms such as "attached to," "coupled to," and "configured for coupling to" and "secured to" (for example, a first component is "coupled to" or "is configured for coupling to" or is "secured to" a second component), or "communicate" (for example, a first component "communicates with" or "is in communication with" a second component) are used in this application to indicate a structural, functional, mechanical, electrical, signal, optical, magnetic, electromagnetic, ionic or fluidic relationship between two or more components (or elements, features, or the like). As such, the fact that one component is said to couple to a second component is not intended to exclude the possibility that additional components may be present between, and/or operatively associated or engaged with, the first and second components.

Although the previous description only illustrates particular examples of various implementations, the present disclosure is not limited to the foregoing illustrative examples. A person skilled in the art is aware that the disclosure as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. Modifications and variations are possible in light of the above description.

What is claimed is:

1. A lockout device configured to be removably received over a cylindrical portion of a push-pull circuit-breaker knob, the lockout device comprising:

an attachment member having a generally C-shaped collar defining a cylindrical recess therein, the collar being configured to be resiliently expanded to be positioned over and receive the cylindrical portion of the circuit-breaker knob and then contract, in a manner that prevents the circuit breaker knob from being depressed to close the circuit breaker; and a retainer member depending from and integrated into the attachment member, having a first channel member and a second channel member, each channel member having a channel that forms a cable channel configured to secure and hold in place a wire cable that, when threaded into the retainer member and tightened, holds the lockout device in place on the cylindrical portion of a push-pull circuit-breaker knob; and a locking mechanism having a first passageway configured to accept and receive a first end of the wire cable and a second passageway configured to accept and receive a second end of the wire cable after its insertion into and through the cable channel.

2. The lockout device of claim 1, wherein the attachment member and the retainer member of the lockout device are made from the group consisting of acrylonitrile butadiene styrene (ABS), polymethyl methacrylate (PMMA), polystyrene, and combinations of the foregoing.

3. The lockout device of claim 1, wherein each channel of the first channel member and the second channel member includes a horizontal portion and a vertical portion, and the channel of the first channel member and the channel of the second channel member are connected by a crossover channel; and wherein the first channel member, the second channel member, and the crossover channel all form the cable channel.

4. The lockout device of claim 3, wherein the generally C-shaped collar includes a first free end attached to the first channel member and a second free end attached to the second channel member, wherein the generally C-shaped collar is enabled to flex apart at the first free end and the second free end to be positioned over and receive the cylindrical portion of an extended circuit breaker.

5. The lockout device of claim 4, further including a gap separating the generally C-shaped collar of the attachment member at the first free end and the second free end, and separating the first channel member from the second channel member of the retainer member.

6. A lockout system for preventing actuation of a push-pull circuit breaker knob, the lockout system comprising:

a lockout device comprising:

an attachment member having a generally C-shaped collar defining a cylindrical recess therein, wherein the C-shaped collar resiliently expands to be positioned over and receive a cylindrical portion of the circuit breaker knob when extended and contracts when in position; and a retainer member depending from and integrated with the attachment member, having a first channel member and a second channel member;

forming a cable channel in the retainer member and configured to secure and hold in place a wire cable having a first end and a second end; and a locking mechanism having a first passageway configured to accept and receive the first end of the wire cable and a second passageway configured to accept and receive the second end of the wire cable.

7. The lockout system of claim 6, wherein the locking mechanism includes a locking chamber having two passageways configured to receiving either the first end or the second end of the wire cable inserted therein and tightening the locking chamber on the locking device when the first end is pulled through one passageway and the second end is pulled through the other passageway.

8. The lockout system of claim 6, wherein the wire cable is a flexible steel cable conforming to applicable U.S. Occupational Safety and Health Administration ("OSHA") regulations.

9. The lockout system of claim 6, wherein the locking mechanism includes two pull-to-tighten passageways, each configured to receive either the first end or the second end of the wire cable.

10. The lockout system of claim 6, where the cable channel comprises a first channel in the first channel member, a second channel in the second channel member, and a crossover channel connecting the first channel and the second channel.

11. The lockout system of claim 10, wherein the first channel includes a horizontal portion and a vertical portion, and the second channel includes a horizontal portion and a vertical portion.

12. The lockout system of claim 6, wherein the generally C-shaped collar includes a first free end attached to the first channel member and a second free end attached to the second channel member, wherein the generally C-shaped collar is enabled to flex apart at the first free end and the second free end to be positioned over and receive a cylindrical portion of an extended circuit breaker.

13. The lockout system of claim 12, further including a gap separating the generally C-shaped collar of the attachment member at the first free end and the second free end, and separating the first channel member from the second channel member of the retainer member.

14. A method of installing and removing a lockout system for preventing actuation of a push-pull circuit breaker knob, the method comprising:

disengaging the circuit breaker knob from a circuit breaker on a circuit breaker panel;

applying a lockout device having an attachment member and a retainer member about an actuating cylindrical portion of the disengaged circuit breaker knob, the attachment member having a generally C-shaped collar defining a cylindrical recess therein, the C-shaped collar being configured to be resiliently expanded to be positioned over and receive the actuating cylindrical portion and to contract when in position, and the retainer member having a cable channel formed therein and configured to secure and hold in place a wire cable having a first end and a second end;

threading the wire cable through the cable channel so that the first end of the wire cable extends beyond the first channel member and the second end of the wire cable extend beyond the second channel member;

pulling the first end of the wire cable through a first passageway in a locking chamber;

pulling the second end of the wire cable through a second passageway in the locking chamber until the locking chamber is firmly held against the lockout device; and removing the locking device from the push-pull circuit breaker knob by cutting the wire cable with a wire cutting tool.

15. The method of claim 14, wherein the C-shaped collar is wedged between a head portion of the circuit breaker knob and the circuit breaker panel to prevent the circuit breaker knob from being depressed to engage the circuit breaker.

16. The method of claim 14, further comprising the step of attaching a tagout device to the locking device, the step comprising:

attaching an attachment means to the wire cable of the lockout device; and attaching a tag to the attachment means.

17. The method of claim 16, where the attachment means is a one-piece, all environment-tolerant nylon cable tie.

18. The method of claim 14, wherein the wire cable is a flexible steel cable conforming to applicable U.S. Occupational Safety and Health Administration ("OSHA") regulations.

19. The method of claim 18, wherein the first passageway and the second passageway of the locking chamber are pull-to-tighten passageways.

20. The method of claim 14, wherein the wire cutting tool is a wire cutter and the step of removing the locking device from the push-pull circuit breaker knob further comprises removing the first end of the wire cable and the second end of the wire cable from the locking chamber.

* * * * *